US008496785B2

(12) United States Patent
Wokurek et al.

(10) Patent No.: US 8,496,785 B2
(45) Date of Patent: Jul. 30, 2013

(54) COMBINATION OF A PRESS FELT WITH A PRESSURE ROLL COVERING AND/OR SUCTION ROLL COVERING FOR A PAPER MACHINE

(75) Inventors: Michael Wokurek, Vienna (AT); Johan Einarsson, Ulm (DE); Gamsjäger Norbert, Bad Fischau (AT); Antje Berendes, Grafenbach (AT); Alexander Etschmaier, Neuberg (AT); Franz Grohmann, Payerbach (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/364,715

(22) Filed: Feb. 2, 2012

(65) Prior Publication Data

US 2012/0193058 A1 Aug. 2, 2012

Related U.S. Application Data

(63) Continuation of application No. PCT/EP2010/056173, filed on May 6, 2010.

(30) Foreign Application Priority Data

Aug. 4, 2009 (DE) ..... 10 2009 028 215

(51) Int. Cl.
*D21F 3/08* (2006.01)
*D21F 3/10* (2006.01)
*D21F 7/08* (2006.01)

(52) U.S. Cl.
USPC ..... 162/358.2; 162/358.1; 162/374; 162/900

(58) Field of Classification Search
USPC ..... 100/121; 162/205, 210, 358.1, 358.2, 162/358.4, 367, 368, 374, 900–903
See application file for complete search history.

(56) References Cited

U.S. PATENT DOCUMENTS 1,050,823 A 1/1913 Foreman
3,023,805 A 3/1962 Walker (Continued)

FOREIGN PATENT DOCUMENTS

DE 24 36 293 2/1975
DE 27 04 157 A1 8/1978

(Continued)

OTHER PUBLICATIONS

International Search Report dated Sep. 6, 2010 for International Application No. PCT/EP2010/056173 (5 pages).

(Continued)

*Primary Examiner* — Eric Hug
(74) *Attorney, Agent, or Firm* — Taylor IP, P.C.

(57) ABSTRACT

A combination of a press felt with a pressure and/or suction roll covering for a papermaking machine, including a porous press felt with a carrier structure. The pressure or suction roll covering having a circumferential groove surface structure having a groove width in the range of 0.5 mm to 1.5 mm, a distance between grooves in the range of 1.5 to 2.5 mm and a groove depth in the range of 1.5 mm to 4 mm. A percentage of an open surface relative to an overall surface of the pressure roll covering is in a range of 20% to 50%. The suction roll covering additionally having an arrangement of holes with a plurality of suction holes completely penetrating through the suction roll covering, whereby a percentage of an open surface in relation to an overall surface of the suction roll covering is in a range of 30% to 50%.

16 Claims, 3 Drawing Sheets

U.S. PATENT DOCUMENTS

| | | | | | |
|---|---|---|---|---|---|
| 3,198,694 | A | * | 8/1965 | Justus | 162/358.1 |
| 3,198,697 | A | * | 8/1965 | Justus | 162/360.2 |
| 3,562,883 | A | | 2/1971 | Kobayashi | |
| 3,826,713 | A | * | 7/1974 | Nykopp | 162/205 |
| 4,353,296 | A | | 10/1982 | Beucker | |
| 4,366,025 | A | * | 12/1982 | Gordon et al. | 162/358.1 |
| 5,785,818 | A | | 7/1998 | Fekete et al. | |
| 6,004,429 | A | * | 12/1999 | Schiel | 162/111 |
| 6,029,570 | A | * | 2/2000 | Matuschczyk | 100/121 |
| 7,300,552 | B2 | * | 11/2007 | Edwards et al. | 162/289 |
| 2002/0153116 | A1 | | 10/2002 | Honkalampi et al. | |
| 2007/0000632 | A1 | * | 1/2007 | Westerkamp | 162/358.2 |
| 2008/0196855 | A1 | | 8/2008 | Herman et al. | |
| 2009/0199988 | A1 | | 8/2009 | Westerkamp et al. | |

FOREIGN PATENT DOCUMENTS

| | | | |
|---|---|---|---|
| DE | 85 10 220.2 | U1 | 6/1986 |
| DE | 197 22 638 | A1 | 12/1998 |
| DE | 600 28 908 | T2 | 2/2007 |
| DE | 10 2005 062 334 | A1 | 6/2007 |
| DE | 10 2006 055 827 | A1 | 5/2008 |
| DE | 10 2007 000 578 | A1 | 4/2009 |
| EP | 0 187 967 | A2 | 7/1986 |
| EP | 0 273 613 | A1 | 7/1988 |
| EP | 0 285 376 | A2 | 10/1988 |
| EP | 0 290 653 | A1 | 11/1988 |
| EP | 0 464 258 | A1 | 1/1992 |
| EP | 1 127 976 | A2 | 8/2001 |
| EP | 1 496 152 | A1 | 6/2004 |
| EP | 1 754 822 | A2 | 2/2007 |
| EP | 2 072 667 | A1 | 7/2008 |
| EP | 2 072 669 | A1 | 7/2008 |
| EP | 1 956 140 | A2 | 8/2008 |
| EP | 2 072 668 | A1 | 6/2009 |
| EP | 2 072 670 | A1 | 6/2009 |
| EP | 2 072 675 | A2 | 6/2009 |
| EP | 2 072 676 | A1 | 6/2009 |
| GB | 1157407 | | 7/1969 |
| WO | 2008095055 | A1 | 8/2008 |
| WO | 2009019051 | | 2/2009 |

OTHER PUBLICATIONS

Ullmann's Encyclopedia of Industrical Chemistry; Wiley-VCH; vol. 28; Sixth, Completely Revised Edition; Polyacrylates to Polyrethanses; 2003; p. 667.

Thermoplasticsche polyurethan-Elastomere (TPU), Elastollan-Materialeigenschaften; Feb. 2005.

Paper Technology Journal "Twogether"; Aug. 21, 2006; Voith Paper Rolls Launches the Latest Generation of Polyurethane Covers.

Paper Technology Journal "Twogether"; Aug. 30, 2010; Neuer Polyurethanbezug Fur Presswalzen.

* cited by examiner

COMBINATION OF A PRESS FELT WITH A PRESSURE ROLL COVERING AND/OR SUCTION ROLL COVERING FOR A PAPER MACHINE

CROSS REFERENCE TO RELATED APPLICATIONS

This is a continuation of PCT application No. PCT/EP2010/056173, entitled "COMBINATION OF A PRESS FELT WITH A PRESSURE ROLLER COVERING AND/OR A SUCTION ROLLER COVERING FOR A PAPER MACHINE", filed May 6, 2010, which is incorporated herein by reference.

BACKGROUND OF THE INVENTION

1. Field of the Invention

The current invention relates to a combination of a press felt with a pressure roll covering and/or a suction roll covering which can be used in the press section of a paper making machine, or in a machine for the production of a web material, for example paper or cardboard.

2. Description of the Related Art

During the production of paper a substantial part of the liquid, generally water, which is contained in the base material provided for the production of paper, is removed in a press section. The base material is carried on one, or respectively between two press felts through generally several press nips which are used in conjunction with a pressure roll and/or suction roll. The aim of this process is to remove the greatest possible volume of liquid from the material whereby at the same time the energy expenditure, primarily for the production of a vacuum in the region of one or several suction rolls, is to be reduced.

What is needed in the art is a press felt and roll covering that provides improved dewatering with a lower expenditure of energy.

SUMMARY OF THE INVENTION

It is therefore the objective of the current invention to cite a combination of a press felt with a pressure roll covering and/or a suction roll covering for a paper making machine which provides improved dewatering characteristics and lower energy expenditure.

According to one embodiment of the present invention this objective is met by a combination of a press felt with a pressure roll covering and/or a suction roll covering for a paper machine, whereby the combination includes:

a) a porous press felt with a carrier structure and polyurethane material embedded in the carrier structure and/or with at least one layer of non-woven material, b) a pressure roll covering with a circumferential groove surface structure having a groove width in the range of 0.5 mm to 1.5 mm, a distance between grooves in the range of 1.5 to 2.5 mm and a groove depth in the range of 1.5 mm to 4 mm, whereby the percentage of an open surface in relation to the overall surface of the pressure roll covering is in the range of 20% to 50%, and/or a suction roll covering with a circumferential groove surface structure having a groove width in the range of 0.5 mm to 1.5 mm, a distance between grooves in the range of 1.5 mm to 2.5 mm and a groove depth in the range of 1.5 mm to 4 mm, and an arrangement or holes with a plurality of suction holes completely penetrating through the suction roll covering, whereby the percentage of an open surface in relation to the overall surface of the suction roll covering is in the range of 30% to 50%.

It was noticed that with the combination of a specially constructed press felt which possesses a comparatively low porosity, in other words a comparatively low hollow space volume and a cover constructed for a pressure roll or respectively a suction roll as previously described, very good dewatering characteristics are achieved, while at the same time the energy used to produce the vacuum or respectively to remove liquid by means of the vacuum can be reduced in particular in the region of a suction roll due to the comparatively open design of the roll covering.

Further improvement of the liquid absorption capacity, of the pressure roll covering is obtained by an arrangement of holes with a plurality of blind holes which are open facing the top side of the pressure roll covering. The pressure roll covering has a circumferential groove surface structure and the holes do not completely penetrate there through with the open surface being provided by the circumferential groove surface structure and the disposition of the holes.

The suction roll covering may also provide that its hole arrangement includes a plurality of blind holes which do not completely penetrate the covering and which are open facing the top side of the suction roll covering which has a circumferential groove surface structure.

In order to further improve absorption of liquid in the hole arrangement, it is suggested that the holes in the hole arrangement of the suction roll covering and/or in the hole arrangement of the pressure roll covering have a diameter in the range of 2 mm to 5 mm.

In one variation of the present invention, which is very advantageous in regard to the liquid absorption capacity it is suggested that the pressure roll covering and/or the suction roll covering has a modulus of elasticity in the range of $50N/mm^2$ to $500N/mm^2$. It has been found that such a low modulus of elasticity, which has a comparatively good deformability of the construction material further improves the liquid absorption capacity. Also, a hollow space volume share in the range of 200 to 1500 $cm^3/m^2$ contribute to the liquid absorption capacity.

The pressure roll covering, or respectively the suction roll covering is preferably made of polyurethane material whereby the desired deformability is combined with the necessary durability under constant pressure load.

Moreover, the thickness of the pressure roll covering, or respectively also the suction roll covering, is in the range of 10 mm to 13 mm.

In order to ensure that the press felt according to the inventive combination of the present invention is constructed with a comparatively low hollow space volume whereby it can be achieved that the greater portion of water pressed from the paper, which is to be manufactured, reaches the roll covering it is suggested that polyurethane material is integrated into at least one layer of the press felt that consists of non-woven material. The provision of polyurethane material in the non-woven material reduces the hollow space volume of the non-woven material, whereby this material already possesses a clearly reduced hollow space volume share than for example that of a woven material.

The basis weight content of the polyurethane material in the press felt is in a range of 50 $g/m^2$ to 700 $g/m^2$. The press felt has a hollow space volume content of less than 600 $cm^3/m^2$, preferably less than 500 $cm^3/m^2$, most preferably of less than 400 $cm^3/m^2$. This at least one layer of non-woven material or respectively fiber-/thread-material and/or the carrier structure may be a laid scrim, formed fabric or a warp knit fabric.

In the provision of a carrier structure with therein integrated polyurethane material, the comparatively low hollow space volume share can, for example, also be achieved if woven material is utilized as a carrier structure and the porosity is provided by way of a coating of polyurethane material carried by and therefore incorporated in this carrier structure.

The present invention further relates to a papermaking machine with a press section in which the inventive combination is provided.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
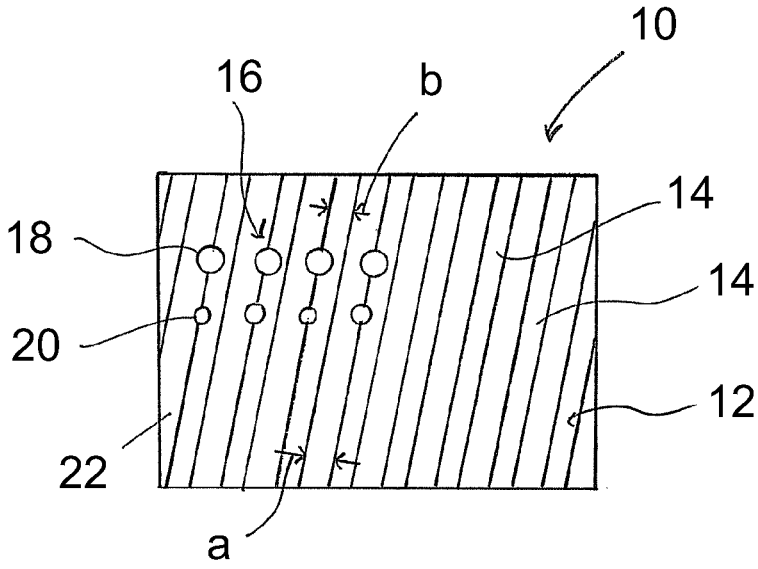
FIG. 1 illustrates a top view of an embodiment of a surface area of a suction roll covering of the present invention.
Figure 2:
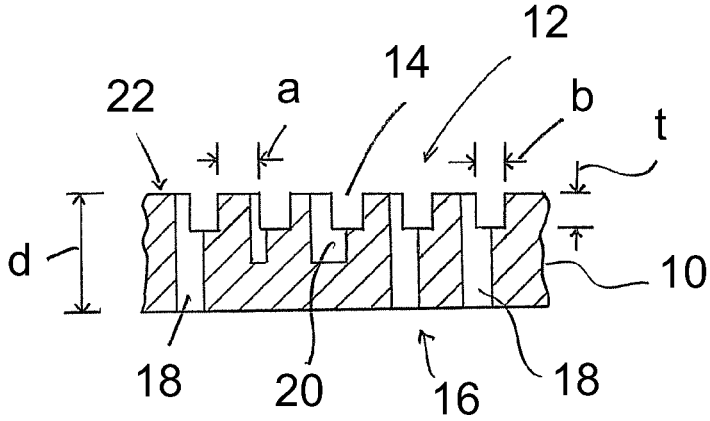
FIG. 2 illustrates a sectional view of the suction roll covering of FIG. 1.
Figure 5:
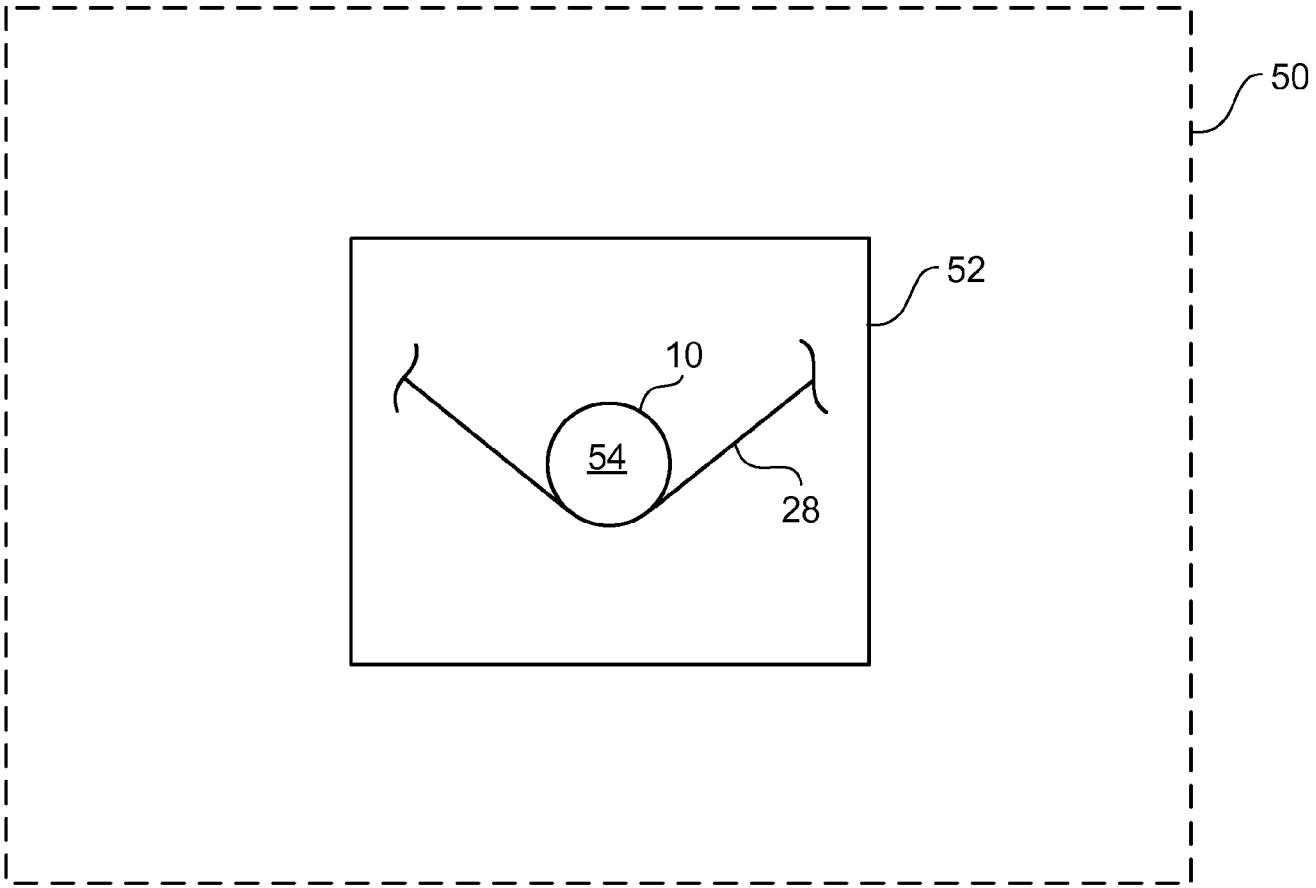
FIG. 5 is a schematical illustration of a papermaking machine utilizing a roll with the covering illustrated in FIGS. 1 and 2, and the press felt illustrated in FIGS. 3 and 4.

Referring now to the drawings, and more particularly to FIGS. 1 and 2 there is illustrated an exemplary suction roll covering 10 utilized on a suction roll 54 as shown if FIG. 5. In the top view of FIG. 1 the spiral circumferential groove surface structure 12, provided on an outside circumference of the wall and extending approximately in circumferential direction, can be seen. This construct includes a plurality of adjacently positioned groove segments 14 extending transversely to the longitudinal direction of the roll 54. These groove segments 14 which, based on the spirally wound structure are positioned slightly diagonally relative to the circumferential direction have a width 'b' in the range of 0.5 mm to 1.5 mm and a distance 'a' from each other in the range of 1.5 mm to 2.5 mm. Groove depth 't' is in a range of 1.5 mm to 4 mm.

Moreover, a hole arrangement 16 is disposed in suction roll covering 10, which is, for the purpose of illustration, only illustrated in a portion of the top view in FIG. 1. Hole arrangement 16 includes a plurality of suction holes 18 which penetrate completely through suction roll covering 10 and through which the liquid that is removed from the paper, which is to be manufactured, can be sucked off.

Hole arrangement 16 further includes a plurality of blind or pocket holes 20, which like suction holes 18 are open to top side 22 which; however, do not penetrate completely through suction roll covering 10 which is constructed having a thickness 'd' in the range of 10 to 13 mm.

As is shown in FIG. 2, suction holes 18 and blind holes 20 may have different diameters, whereby the diameter of these holes is preferably in the range of 2 mm to 5 mm. As shown in FIG. 1, all suction holes 18 may, for example, also have the same diameter and all blind holes 20 may have the same diameter, whereby the diameter of suction holes 18 does not necessarily have to be the same diameter as the diameter of blind holes 20. Suction holes 18 and blind holes 20 are preferably distributed in a uniform pattern across suction roll covering 10 in such a manner that, as illustrated in FIGS. 1 and 2, at least most, preferably all suction holes 18 or respectively also blind holes 20 intersect a groove segment 14. This means that the liquid absorbed in one groove segment 14 can then get into holes 18 or 20 and can consequently be removed from the region of the paper, which is to be manufactured.

Through the circumferential groove surface structure 12 and holes 18 and 20, which are open facing top side 22, an open surface is provided whose percentage in relation to the overall surface, which is substantially formed by a cylindrical circumferential surface of the suction roll covering, is in a range of 30% to 50%. With this comparatively large surface component, through which liquid can be directly removed, an excellent dewatering capacity is achieved together with the liquid absorption volume formed by the groove structuring and different holes 18, 20. In this embodiment of the present invention the hollow space volume share in suction roll covering 10 is preferably in a range from 200 to 1500 $cm^3/m^2$.

A pressure roll covering, which for the purpose of discussion can be considered a pressure roll covering 10, for a pressure roll 54 for use in a press section 52 of a papermaking machine 50 can be designed as shown in FIGS. 1 and 2 and can essentially also be designed, in particular in regard to the circumferential groove surface structure, according to the previously stated dimensions. Also, on the roll cover for use on a pressure roll 54, a hole arrangement 16 can be provided which does not include any suction holes 18, but only blind holes 20. On a pressure roll covering 10 the percentage of the open surface provided by blind holes 20 and by the circumferential groove surface structure 12 is in a range of 20% to 50% of the overall surface. The hollow space volume share is in the range of 200 to 1500 $cm^3/m^2$.

In order to provide the required elasticity for suction roll cover 10 or respectively also for the appropriately designed pressure roll covering, roll coverings of this type may for example be constructed with polyurethane and have a modulus of elasticity in the range of 50N/$mm^2$ to 500N/$mm^2$.

Figure 3:
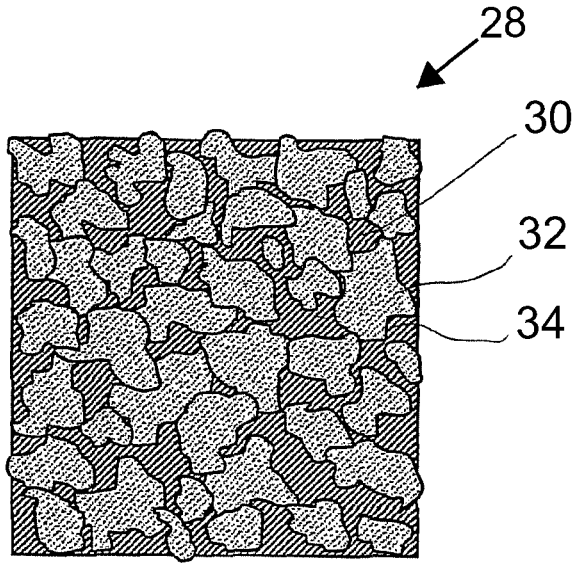
FIG. 3 is a partial schematic diagram of a press felt constructed with embedded polyurethane material, the press felt being used with the covering of FIGS. 1 and 2.
Figure 4:
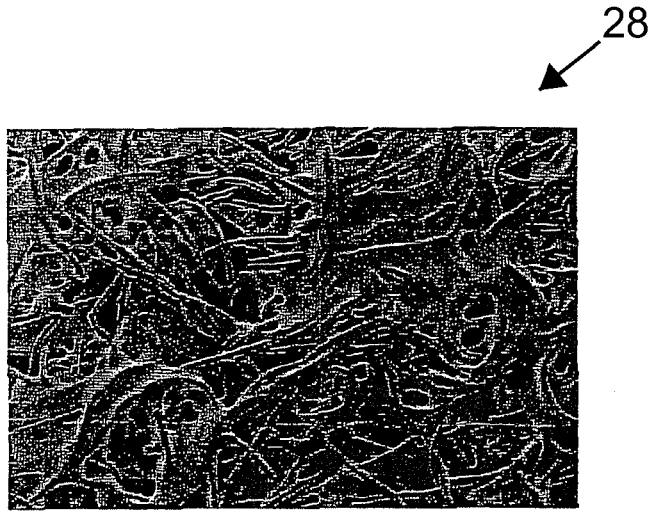
FIG. 4 is a microscopic photograph of the surface of a press felt of FIG. 3 constructed with embedded polyurethane material.

Now, additionally referring to FIGS. 3-5, there is shown a porous press felt 28 used in a dewatering section 52 of a papermaking machine 50. In order to be able to optimally utilize the dewatering properties provided by the previously described suction, or pressure, roll coverings they are utilized in connection with a seamed or seamless press felt 28. In particular compared to the roll coverings, this press felt 28 has a comparatively low hollow space volume content of less than 600 $cm^3/m^2$, preferably less than 500 $cm^3/m^2$, most preferably of less than 400 $cm^3/m^2$. The hollow space volume of press felt 28 can hereby be determined, the same as on the previously discussed roll coverings for example at a pressure of 5 MPa on a 10 cm×10 cm area on a press felt 28 which was pre-conditioned overnight in water.

This hollow space volume is provided in press felt 28 that includes at least one layer of non-woven fiber-/thread-material, for example composed of monofilaments or respectively conventional yarns. Non-woven material of this type can, for example, include a single- or multi-layer laid scrim, a non-woven material or a warp knit structure. Also the use of a composite material of a multitude of spiral or helix wound elements connected by a pintle wire represents the use of non-woven material in the sense of the current invention.

Basically, press felt 28 may also be multi-layered and include thereby at least one such layer of non-woven material.

Non-woven material of this type, in particular if it is a fibrous or warp knit structure, compared to a woven fiber or yarn material possesses a comparatively low porosity. This can be further supported by introducing polyurethane material into the non-woven material or into at least one layer thereof, thereby further lowering the hollow space volume share. This is illustrated in FIG. 3.

One can see the fibrous material 30 indicated by solid line cross hatched area which is made up, for example, as non-woven material into which interconnected polyurethane material 32 is embedded. This can be produced in that small polyurethane particles 34 are brought into the non-woven fibrous material and are then fused by means of heat and/or pressure so that a substantially coherent bond is created through appropriate deformation of the polyurethane particles 34, which also maintains a pore structure in the thereby composed press felt 28.

FIG. 4 illustrates a microscopic depiction of the surface of a press felt 28 composed as discussed, in which the substantially statistically distributed fibers of the fibrous material are recognizable as well as the polyurethane material encasing them and which is therefore fundamentally integrated in the fibrous material.

Due to the integration of polyurethane material into the non-woven fibrous material, which in this case is used as a carrier structure, not only is the porosity influenced, but also the elasticity of press felt 28 is adjusted so that interaction with the previously discussed roll coverings leads to improved dewatering characteristics. It has been shown that, in particular when the polyurethane material is provided at a base weight of 50 $g/m^2$ to 700 $g/m^2$, excellent dewatering characteristics with comparatively low remoistening can be achieved.

An alternative embodiment of a press felt 28 of the present invention can basically also be designed, for example, with a woven carrier structure into which polyurethane material is integrated, either in the previously discussed sense so that the warp threads and/or weft threads of the woven structure being used as carrier structure are encased with the polyurethane while maintaining a certain porosity, or so that a substantially tight bond is produced with the polyurethane material on at least one side of the carrier structure.

With the inventive combination of a press felt 28 of the previously discussed construct with a pressure roll covering and/or a suction roll covering also of the discussed construct a constant nip pressure in a press section of a paper machine is produced due to the comparatively wide and deep groove structure, the comparatively low modulus of elasticity of the utilized polyurethane material, the comparatively large open surface share, the comparatively large hollow space volume share, in particular in the roll coverings or respectively also the provided hole arrangements.

On the other hand, dewatering through the roll coverings, in particular through the suction roll covering is clearly improved. A substantial contribution hereto is that the utilized press felt 28 has clearly reduced remoistening characteristics due to its structure or respectively, also due to its porosity with a preferably lower hollow space volume share than the press roll covering and/or the suction roll covering and therefore also facilitates separation of press felt 28 from the paper layer which is initially transported on it and subsequently separated from it. A press felt 28 which includes one or several polyurethane layers, possibly on one carrier structure, which have a lower hollow space volume than a press felt 28 produced through needling may in particular contribute to these desirable characteristics.

Tests have shown that the surface structure of suction roll covering 10, its open area as well as the construct of press felt 28 for the dewatering efficiency and also for the dry content of the paper are important. With the same open area of suction roll covering 10 and the same hollow space volume of press felt 28 the dewatering characteristic, the dry content of the paper and the so-called sheet bulk, in other words the paper thickness are influenced.

In addition to the surface structuring of the rolls 54 and the design of press felt 28, the design of the press section of the paper machine also influences dewatering respective to the dry content of the web. Two basic concepts are known here, the so-called "nip-dewatering", in other words dewatering in the press nip, and suction through a so-called Uhle-box outside the press nip. Both possibilities are sufficiently known so that a detailed description can be foregone.

The vacuums which are applied in a suction- or suction press roll 54 in a known manner, for example, through at least one suction box in at least two zones, can be reduced or even turned off with a suitable combination of press felt 28 and roll covering 10, whereby dewatering remains the same or may even be improved. It is therefore possible to achieve the same dry content or even an increase of the dry content in spite of a lower vacuum in a first suction zone of a suction press roll 54, so that a lowering of the vacuum in a second suction zone of the suction press roll 54 may occur. This was confirmed in trials with all suction press roll surface designs and all press felts. It is therefore possible to now provide the vacuum in only one suction zone. Suction in additional zones can be eliminated which has a positive effect on the use of energy.

The suction power can also be significantly reduced when using the Uhle-box. With the surface design with suction holes 18 and circumferential groove surface structure 12 the Uhle-box may even be turned off.

In regard to line loads during nip-dewatering, the highest loads can be achieved with suction press rolls having a surface design which has suction holes 18, circumferential groove surface structure 12 and blind holes 20. As expected, a lowering of the line load in this case leads to a lower dry content.

Overall dewatering can be kept substantially neutral with presses having several press nips when using suction press roll coverings with suction holes 18 and circumferential groove surface structure 12.

Considering the energy consumption of the roll drives, an insignificant increase can be observed at the same machine speed and same vacuum. This is however at least compensated for by the lowering of the vacuums as already discussed above.

When using suction rolls 10 with suction holes 18 and circumferential groove surface structure 12, low consumption of drive power is registered.

Overall, in trials at the same speed of the paper machine a dry content of up to 1.5% higher could be achieved, whereby suction- or suction press rolls with a design incorporating suction holes 18 and a circumferential groove surface structure 12 achieve the best results. The paper bulk can be increased by up to 6% with the same surface design and the same machine speed.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A combination of a press felt and at least one of a press roll cover and a suction roll cover with a papermaking machine, comprising a porous press felt having a supporting structure, within said support structure there being embedded a polyurethane material (32), wherein said polyurethane material (32) in said press felt having a surface content within a range of 50 g/m$^2$ to 700 g/m$^2$, and wherein said press felt having a void volume fraction of less than 600 cm$^3$/m$^2$, the press roll cover including a circumferential groove surface structure having a groove width in a range of 0.5 mm to 1.5 mm, a groove spacing in a range of 1.5 mm to 2.5 mm and a groove depth in a range of 1.5 mm to 4 mm, wherein a proportion of an open surface area of a total surface area of the press roll cover is in a range of 20% to 50%, the suction roll cover (10) having a circumferential groove surface structure (12) including a groove width (b) in a range of 0.5 mm to 1.5 mm, a groove distance (a) in a range of 1.5 mm to 2.5 mm and a groove depth (t) in a range of 1.5 mm to 4 mm, and with a pinhole arrangement (16) having a plurality of suction holes (18) passing completely through the suction roll cover, wherein a proportion of an open surface of a total surface area of the suction roll cover is in a range of 30% to 50%, said press roll cover and said suction roll cover being constructed with a polyurethane material having a modulus of elasticity in a loading range of 50 N/mm$^2$ to 500 N/mm$^2$ and a void fraction ranging from 200 to 1500 cm$^3$/m$^2$.

2. The combination of claim 1, wherein the press roll covering includes an arrangement of holes with a plurality of blind holes which are open facing a top side of the press roll covering, the press roll covering having a circumferential groove surface structure, the blind holes do not completely penetrate through the press roll covering, the open surface being provided by the circumferential groove surface structure and the disposition of the holes.

3. The combination of claim 1, wherein said pinhole arrangement (16) of said suction roll cover (10) includes a plurality of blind holes (20) which are open facing a top side of the suction roll covering, the suction roll covering having a circumferential groove surface structure, the blind holes do not completely penetrate through the suction roll covering.

4. The combination of claim 3, wherein the suction holes and blind holes of the pinhole arrangement (16) of the suction roll cover (10) and the arrangement of the blind holes of the press roll cover have a diameter in a range of 2 mm to 5 mm.

5. The combination of claim 1, wherein the press roll cover and the suction roll cover (10) has a thickness in a range of 10 mm to 13 mm.

6. A combination of a press felt with at least one of a press roll and a suction roll relative to a papermaking machine, comprising:

a porous press felt having at least one of scrims and warp knit with a layer of non-woven material (30), wherein the press felt has a cavity volume fraction of less than 600 cm$^3$/m$^2$;

a press roll cover associated with the press roll, said press roll cover including a circumferential groove surface structure having a groove width in a range from 0.5 mm to 1.5 mm, a groove spacing in a range from 1.5 mm to 2.5 mm and a groove depth in a range from 1.5 mm to 4 mm, wherein a proportion of an open surface to a total surface of the press roll cover is in a range of 20% to 50%; and a suction roll cover (10) associated with the suction roll, said suction roll cover having a circumferential groove surface structure (12) with a groove width (b) in a range from 0.5 mm to 1.5 mm, a groove distance (a) in a range from 1.5 mm to 2.5 mm and a groove depth (t) in a range from 1.5 mm to 4 mm, said suction roll cover having a pinhole arrangement (16) with a plurality of suction holes (18) passing completely through said suction roll cover, wherein a proportion of an open surface to a total surface area of the suction roll cover (10) is in a range of 30% to 50%, said press roll cover and/or said suction roll cover being constructed with a polyurethane material having a modulus of elasticity in a range of 50 N/mm$^2$ to 500 N/mm$^2$ and a void volume fraction in a range of 200-1500 cm$^3$/m$^2$.

7. The combination of claim 6, wherein the press roll covering includes an arrangement of holes with a plurality of blind holes which are open facing a top side of the press roll covering, the press roll covering having a circumferential groove surface structure, the blind holes do not completely penetrate through the press roll covering, the open surface being provided by the circumferential groove surface structure and the disposition of the holes.

8. The combination of claim 6, wherein said pinhole arrangement (16) of said suction roll cover (10) includes a plurality of blind holes (20) which are open facing a top side of the suction roll covering, the suction roll covering having a circumferential groove surface structure, the blind holes do not completely penetrate through the suction roll covering.

9. The combination of claim 8, wherein the suction holes and blind holes of the pinhole arrangement (16) of the suction roll cover (10) and the arrangement of the blind holes of the press roll cover have a diameter in a range of 2 mm to 5 mm.

10. The combination of claim 6, wherein the press roll cover and the suction roll cover (10) has a thickness in a range of 10 mm to 13 mm.

11. The combination of claim 6, wherein at least one layer of the press felt of non-woven material (30) includes a polyurethane material (32).

12. The combination of claim 11, wherein the polyurethane material (32) in the press felt has a surface content in a range of 50 g/m$^2$ 700 g/m$^2$.

13. The combination of claim 12, wherein the press felt has a void volume fraction of less than 500 cm$^3$/m$^2$.

14. The combination of claim 13, wherein said void volume fraction is less than 400 cm$^3$/m$^2$.

15. The combination of claim 6, wherein the press felt includes at least one layer of non-woven material and/or a fiber-/thread-material, at least one of the layer of non-woven material, the fiber-/thread-material and the carrier is one of a laid scrim, a formed material and a warp knit fabric.

16. A papermaking machine, comprising a press section with a combination of a press felt with a pressure roll cover and/or a suction roll cover, the press felt being a porous press felt having a supporting structure, within said support structure there being embedded a polyurethane material (32), wherein said polyurethane material (32) in said press felt having a surface content within a range of 50 g/m$^2$ to 700 g/m$^2$, and wherein said press felt having a void volume fraction of less than 600 cm$^3$/m$^2$, the press roll cover including a circumferential groove surface structure having a groove width in a range of 0.5 mm to 1.5 mm, a groove spacing in a range of 1.5 mm to 2.5 mm and a groove depth in a range of 1.5 mm to 4 mm, wherein a proportion of an open surface area of a total surface area of the press roll cover is in a range of 20% to 50%, the suction roll cover (10) having a circumferential groove surface structure (12) including a groove width (b) in a range of 0.5 mm to 1.5 mm, a groove distance (a) in a range of 1.5 mm to 2.5 mm and a groove depth (t) in a range of 1.5 mm to 4 mm, and with a pinhole arrangement (16) having a plurality of suction holes (18) passing completely through the suction roll cover, wherein a proportion of an open surface of a total surface area of the suction roll cover is in a range of 30% to 50%, said press roll cover and said suction roll cover being constructed with a polyurethane material having a modulus of elasticity in a loading range of 50 $N/mm^2$ to 500 $N/mm^2$ and a void fraction ranging from 200 to 1500 $cm^3/m^2$.

* * * * *